United States Patent [19]

Goguillot

[11] 4,087,916

[45] May 9, 1978

[54] DRAWING TABLE WITH A TELESCOPIC ARM

[76] Inventor: Claude Goguillot, 17, rue des Martinets, 25290 Ornans, France

[21] Appl. No.: 740,210

[22] Filed: Nov. 9, 1976

[30] Foreign Application Priority Data

Nov. 12, 1975 France ..... 75 34391

[51] Int. Cl.[2] ..... B43L 13/00

[52] U.S. Cl. ..... 33/76 R; 33/79 R; 403/109

[58] Field of Search ..... 33/76 R, 79 R, 161, 33/76 VA; 403/109

[56] References Cited

U.S. PATENT DOCUMENTS

| | | | |
|---|---|---|---|
| 1,557,923 | 10/1925 | Carroll | 33/161 |
| 2,168,188 | 8/1939 | Bernhard | 403/109 |
| 2,173,146 | 9/1939 | Wright | 33/79 R |
| 2,772,550 | 12/1956 | Harrington | 403/109 |
| 3,115,706 | 12/1963 | Butler | 33/79 R |
| 3,180,028 | 4/1965 | Roccati | 33/79 R |

FOREIGN PATENT DOCUMENTS

| | | | |
|---|---|---|---|
| 1,208,267 | 2/1960 | France | 33/76 |

*Primary Examiner*—Steven L. Stephan
*Assistant Examiner*—John W. Shepperd
*Attorney, Agent, or Firm*—Cameron, Kerkam, Sutton, Stowell & Stowell

[57] ABSTRACT

A drawing table has a drawing board with a telescopic arm slidably mounted on a rail secured to the board. The telescopic arm has a base sliding on the rail and the other end of the telescopic arm supports a drawing set. The telescopic arm includes braking means provided by magnetic strips arranged along each telescoping member of the arm with magnets fixed to the members facing the magnetic strips.

1 Claim, 6 Drawing Figures

DRAWING TABLE WITH A TELESCOPIC ARM

BACKGROUND OF THE INVENTION

The present invention relates to a drawing table for use more particularly in industrial drawing and the graphic arts.

In general, a drawing table comprises a drawing board equipped with a drawing set which conventionally consists of scale rules mounted on a dividing head. This drawing set is supported by a means permitting its displacement over part of the board.

Fundamentally there are two types of means permitting the displacement of the dividing head and the rules. According to a first type, the means is a pantograph and according to the second it is a vertical rail supported by a carriage which slides on a rail located in the lower part of the board.

Drawing tables equipped with these known means suffer from several disadvantages.

Firstly, they do not permit the dividing head to be used over an angle of 360° because one or other of the scale rules in disadvantageous manner becomes lodged beneath the pantograph arms or beneath the vertical rail where it is then impossible to perform a drawing stroke.

Moreover, in the case of equipment with a vertical rail, it is very difficult to draw to the left of the rail. As a result, such equipment must be equipped with special means permitting their use by left-handed draughtsmen. It must also be noted that there is a dead area along the left-hand side of the board where the rail is lodged in its extreme position. Therefore the draughtsman cannot use the whole board.

Moreover, and particularly in the case of pantograph equipment, numerous accidents occur, particularly head injuries, as a result of the movement of the arms and the counterweights.

Finally, all these tables require the draughtsman to work in the standing position, which increases fatigue.

BRIEF SUMMARY OF THE INVENTION

The present invention has for its object a drawing table which eliminates the above disadvantages.

As a result of the means according to the invention, the entire surface area provided by the drawing board can be used, and more particularly the left-hand part. The overall dimensions are reduced and left-handed people can use the equipment without difficulty and without any adaptation being necessary. All risk of injury is eliminated and drawing can be carried out in the seated position. The working conditions are therefore greatly improved.

These results are obtained by substituting a telescopic arm for the vertical rail of the prior art equipment.

More specifically, the invention has for its object a drawing table of the type comprising a drawing board equipped with a first displacement means for a drawing set, whereby said means is mounted on a second horizontal displacement means, wherein said first means comprises a telescopic arm constituted by members which are fitted into one another, whereby one end member has its face fixed to the second displacement means, and the other end member supports the said drawing set at its free end.

BRIEF DESCRIPTION OF THE DRAWINGS

The advantages and features of the invention will become more readily understandable from reading the following description relative to non-limitative embodiments and with reference to the attached drawings, wherein show.

DETAILED DESCRIPTION OF THE PREFERRED EMBODIMENTS

Figure 1:
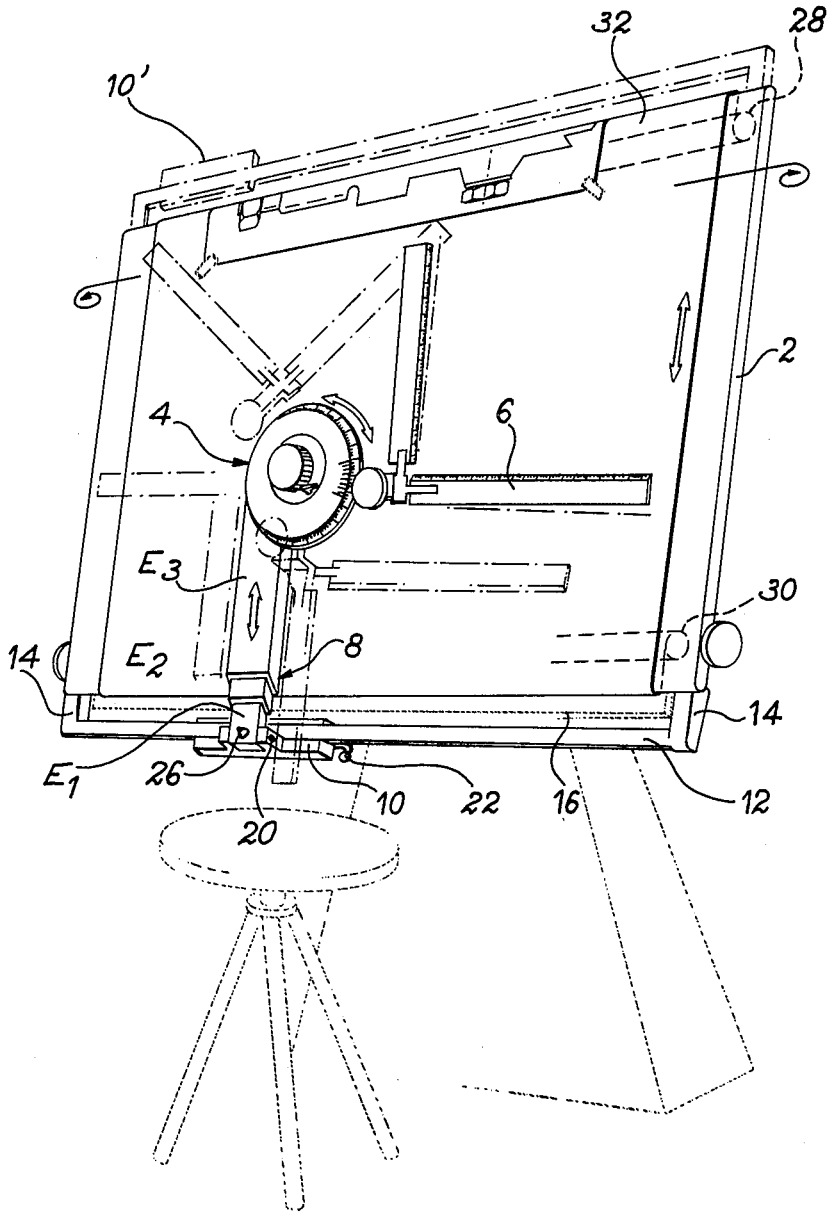
FIG. 1, schematically an overall view of the drawing table according to the invention.

The drawing table shown in FIG. 1 comprises a drawing board 2, a drawing set comprising a dividing head 4 and two scale rules 6 at right angles, a telescopic arm 8 supported by a carriage 10 which can move along a rail 12 connected to the board 2 by rail supports 14, and a pen tray 16 in the form of a groove which serves to house the various instruments and objects necessary for drawing purposes. Locking levers 22 and 26 are provided respectively for the carriage and the telescopic arm.

Obviously the horizontal displacement carriage shown in the lower part of the table in FIG. 1 could also be arranged in the upper part of said table as is indicated in the drawing by broken lines and reference numeral 10'.

As has already been stated, the use of a telescopic arm in place of a vertical rail makes it possible to work over the complete board surface, whilst the left-handed draughtsman can use the equipment without any modification being necessary. In an explanatory manner and to illustrate these advantages, four positions of the drawing set (one in continuous lines, three in broken lines) are shown in FIG. 1.

According to an advantageous embodiment, the drawing table may comprise additionally rolling up and down devices 28 and 30 located respectively at the upper and lower edges of the drawing board. By means thereof it is possible to displace in accordance with the arrow a flexible and/or transparent sheet 32, for example made from plastic material, to which are fixed drawings, plans, symbols, marks, etc.

In drawing tables having a vertical rail, such rolling up and down systems can only be positioned along the right-hand and left-hand edges of the table because the existence of a vertical rail supported on the board by means of a carriage at one end and a roller at the other prevent the vertical unrolling of a sheet. The use of a telescopic arm in accordance with the present invention makes it possible to position these members along the upper and lower sides of the board.

This arrangement provides the drawing table with a considerable advantage because it permits the draughtsman to bring his working plane to the most convenient height and consequently he can work in the seated position.

Figure 2:
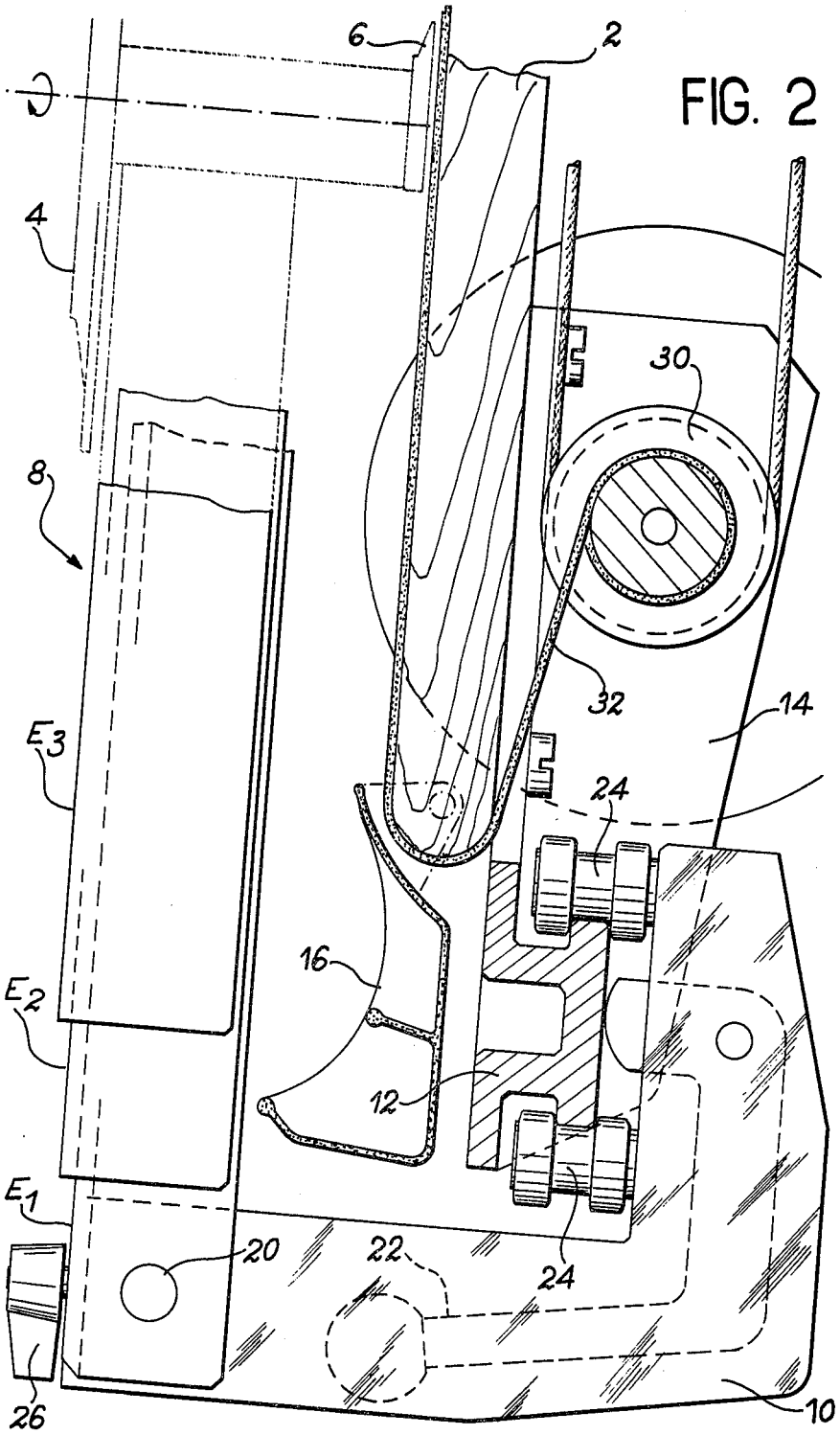
FIG. 2, in greater detail and in section the articulation of the telescopic arm with the horizontal displacement carriage and the rolling on system.

FIG. 2 illustrates in greater detail the articulation of the essential members comprising the table according to the invention. These members are located either in the lower part of the board or in the upper part thereof.

This drawing shows the members mentioned with reference to FIG. 1 and namely telescopic arm 8 supporting dividing head 4 and rules 6, carriage 10 moving along rail 12 maintained on board 2 by support 14, the winding up and down device 30 for sheet 32 and locking levers 22 and 26.

This drawing also shows the rotation spindle 20 for the telescopic arm and the runners 24 of the carriage on rail 12.

The telescopic arm which can be used according to the invention can be of a per se known type. Like any telescopic system, it comprises two end members and intermediate members, whereby all these members can slide and fit into the others by means of friction rings. It is possible to use a commercially available telescopic system used, for example, for constituting telescopic tripods for the purpose of supporting photographic equipment. However, hereinafter a special embodiment of an improved telescopic arm is described with reference to FIGS. 3 to 6.

Figure 3:
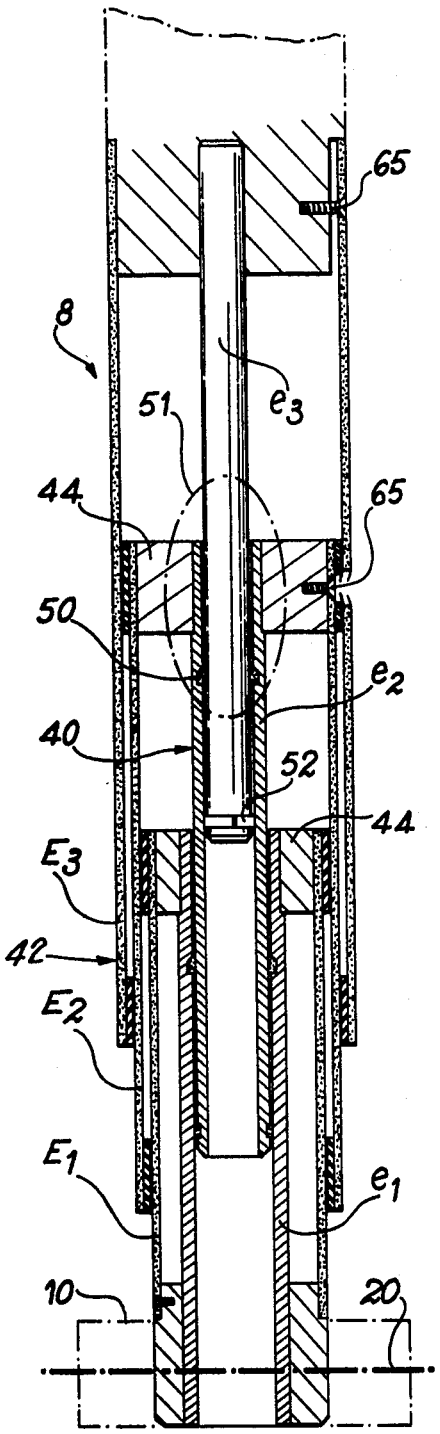
FIG. 3, in section an embodiment of the telescopic arm.

In FIG. 3 the arm shown comprises a first telescopic assembly 40 arranged within a second assembly 42. The first assembly comprises a random number of members $e_1$, $e_2$, $e_3$, etc., of decreasing cross-sections and which fit into one another. Means 51 make it possible to regulate the play between said members and obtain an appropriate friction by means of a ring 50. These means will be described with reference to FIG. 4. A ring 52 is arranged in the lower part of each member to maintain a high level of precision throughout its travel. The external telescopic assembly 42 comprises the same number of members as the first, namely $E_1$, $E_2$, $E_3$, etc., of increasing cross-section. Each internal member is made integral with an external member by means of a bearing 44.

Random materials can be used for making the telescopic arm. Thus, each member can be made from metal (for example, Duralumin) and the friction rings can be made from a plastic material. Random shapes can be used, for example circular for the internal telescopic assembly and trapezoidal for the external telescopic assembly.

An embodiment of the play regulating means 41 is shown in section in FIG. 3. They comprise a split ring 50 (for example made from plastic material) located in a groove. A threaded ring 56 makes it possible to act on ring 50 and adjust the play between the members. When a suitable play is obtained, a locking screw 58 fixes the bearing 44 on the assembly.

Although in most cases this play regulating system ensures a correct operation of the telescopic arm, it may prove advantageous to provide means which serve to ensure that the telescopic arm has a constant length when no force is exerted by the user. Two special embodiments of these means are illustrated in FIGS. 5 and 6.

Figure 5:
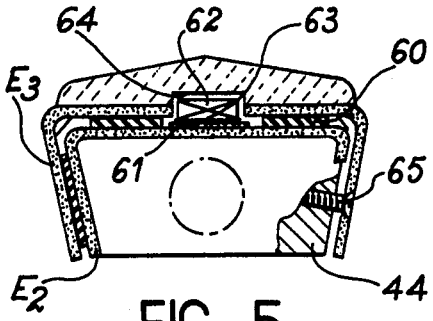
FIG. 5, an embodiment of the telescopic arm braking means.
Figure 4:
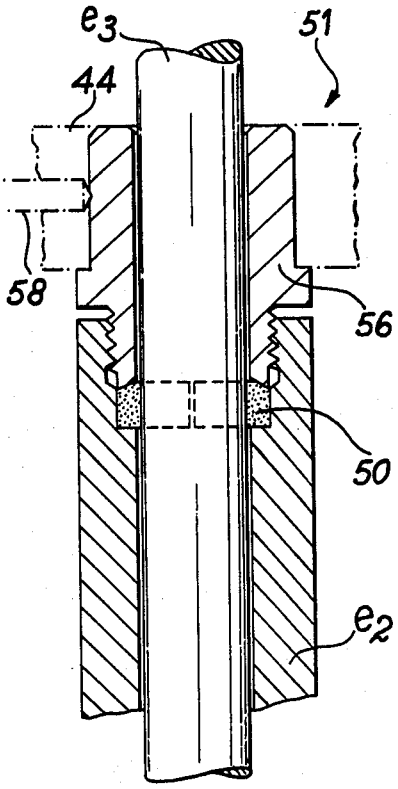
FIG. 4, a means for regulating the play in the members of the telescopic arm.
Figure 6:
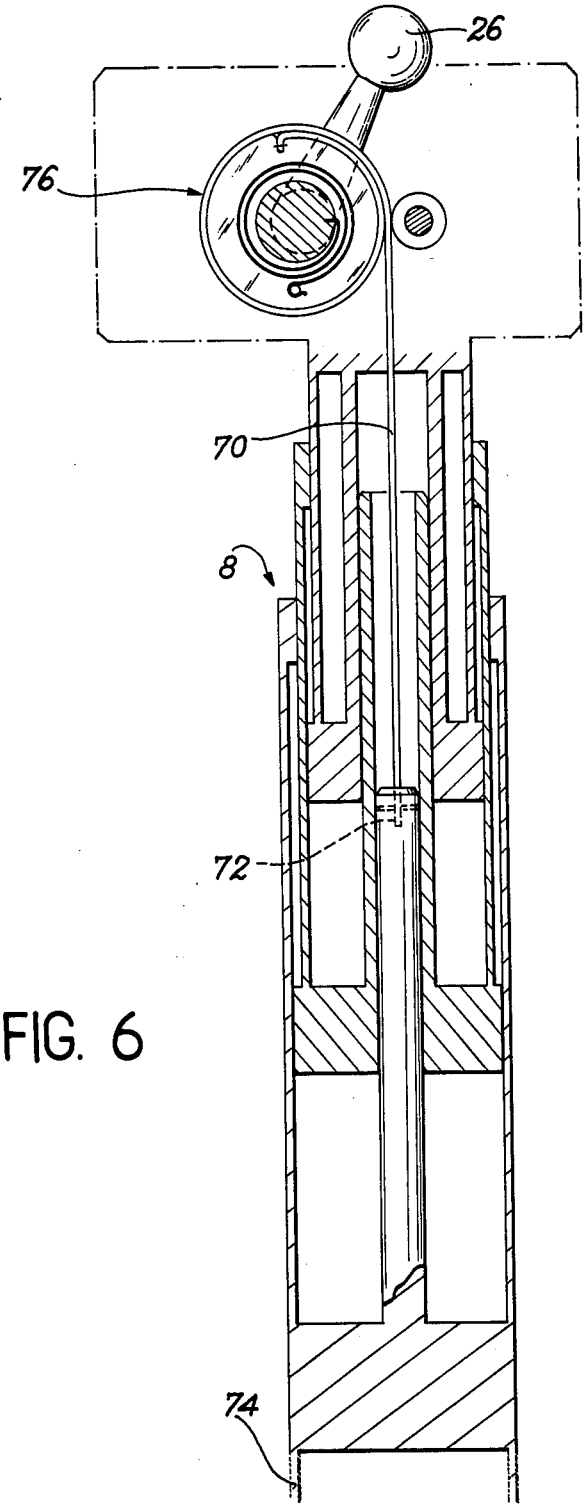
FIG. 6, an embodiment of the telescopic arm locking means.

FIG. 5 shows two members $E_2$ and $E_3$ of a trapezoidally shaped telescopic arm, whereby they are separated by a sliding pad 60 which is integral with member $E_3$. Member $E_2$ has a strip 61 of magnetic material (for example steel). Member $E_3$ has a permanent magnet 62 embedded in a recess 64.

When the user exerts a vertical force on the arm, the magnets slide along the magnetic portion with a certain friction which is added to that caused by the friction rings. When the user exerts no force on the telescopic arm, the friction is sufficient to immobilize the telescopic assembly. The telescopic arm can then be displaced horizontally without its length being modified.

In order to facilitate the sliding of the magnet along the magnetic member, a thin sheet 63, made for example from plastic, can be inserted between the magnet and said member, which also ensures a correct air gap.

FIG. 5 also shows a play regulating device 65 comprising a screw which is accessible from the outside which makes it possible to slightly deform the members and if necessary pick up the play which could occur in the device after a very long period of use.

An embodiment of an arm locking means is shown in FIG. 6 in the case where the movable carriage is located in the upper part of the drawing board, where the telescopic arm is suspended. This means utilises a tape 70 fixed at its lower end 72 to the telescopic arm member supporting the dividing head, whereby the other end engages in a spiral spring-operated winding up and down system 76 equipped with a locking control means 26.

When the user wishes to modify the length of the telescopic arm, he unlocks the winding up and down system 76 in such a way that the tape is wound up if the arm is to be shortened, and unwound if the arm is to be lengthened. If the user wishes to maintain the telescopic arm length constant, he locks the winding up and down means 76 by means of a lever 26. It is then impossible to lengthen the arm under the action of its own weight because the tape prevents this.

Obviously the tape winding up and down device 76 can be arranged in the drawing set (for example, in the dividing head body), whereby the end of the tape is then fixed to the carriage. In this variant the locking lever 26 can be operated by the user's hand which grips the dividing head control means.

The invention is not limited to the embodiments described and represented hereinbefore, and various modifications can be made thereto without passing beyond the scope of the invention.

What is claimed is:

1. A drawing table comprising a drawing board and a telescopic arm constituted by members which fit one another, said arm having first and second end members, a carriage supporting said first end member, a horizontal rail mounted on said board, said rail slidably receiving said carriage, and a drawing set supported by said second end member, each of said members having an outer surface and an inner surface, said outer surface including along its length a magnetic strip and said inner surface including a magnet, a magnet of one member facing a magnetic strip of the adjacent member.

* * * * *